US005238057A

United States Patent [19]

Schelter et al.

[11] Patent Number: 5,238,057

[45] Date of Patent: Aug. 24, 1993

[54] FINNED-TUBE HEAT EXCHANGER

[75] Inventors: Heinrich Schelter, Selb; Rüdiger Herrmann, Münchberg, both of Fed. Rep. of Germany

[73] Assignee: Hoechst Ceramtec Aktiengesellschaft, Selb, Fed. Rep. of Germany

[21] Appl. No.: 548,824

[22] Filed: Jul. 6, 1990

[30] Foreign Application Priority Data

Jul. 24, 1989 [DE] Fed. Rep. of Germany ..... 3924411

[51] Int. Cl.[5] ..... F28F 9/22

[52] U.S. Cl. ..... 165/158; 165/159; 165/905

[58] Field of Search ..... 165/158, 159, 161, 905

[56] References Cited

U.S. PATENT DOCUMENTS

| | | | |
|---|---|---|---|
| 2,185,928 | 1/1940 | Simpson et al. | 165/159 |
| 2,991,048 | 7/1961 | Rabin | 165/159 |
| 3,400,758 | 9/1968 | Lee | 165/159 |
| 3,804,161 | 4/1974 | Nowak | 165/158 |
| 4,068,627 | 1/1978 | Giesecke et al. | 165/158 |
| 4,294,788 | 10/1981 | Laskow et al. | 264/101 |
| 4,385,020 | 5/1983 | Morelock | 264/62 |
| 4,422,499 | 12/1983 | Batistoni | 165/158 |
| 4,570,702 | 2/1986 | Stafford et al. | 165/159 |
| 4,571,331 | 2/1986 | Endou et al. | 264/56 |
| 4,789,506 | 12/1988 | Kasprzyk | 264/60 |

FOREIGN PATENT DOCUMENTS

| | | |
|---|---|---|
| 0032224 | 7/1981 | European Pat. Off. . |
| 0138677 | 4/1985 | European Pat. Off. . |
| 3643749.2 | 6/1988 | Fed. Rep. of Germany . |
| 3720527.7 | 12/1988 | Fed. Rep. of Germany . |

*Primary Examiner*—John Rivell
*Assistant Examiner*—L. R. Leo
*Attorney, Agent, or Firm*—Foley & Lardner

[57] ABSTRACT

In the finned-tube heat exchanger of silicon-infiltrated silicon carbide, in which the tubes of a tube bundle, with the cooling medium flowing around the tubes, are arranged mutually parallel in a housing provided with an inlet and outlet for the cooling medium, the tubes of the tube bundle are joined to one another by fins. The fins have apertures and are arranged transversely to the tube bundle.

3 Claims, 3 Drawing Sheets

FINNED-TUBE HEAT EXCHANGER

The invention relates to a finned-tube heat exchanger made of silicon-infiltrated silicon carbide (SiSiC), in which the tubes of a tube bundle, with the cooling medium flowing around the tubes, are arranged mutually parallel in a housing provided with an inlet and outlet for the cooling medium.

DE-A-3,720,527 has disclosed a heat exchanger in which glass tubes are arranged mutually parallel in a housing. Even though the glass tubes, as a result of appropriate profiling, have significantly greater surface areas as compared with the conventional smooth tubes of circular cross-section, the heat transfer performance is unsatisfactory. This is to be remedied by the invention.

The invention achieves the object by a finned-tube heat exchanger of the type described above, wherein the tubes of the tube bundle are joined to one another by fins which have apertures and are arranged transversely to the tube bundle. The housing can be of cylindrical shape, and the fins can have a circular cross-section and can be arranged with their edges along the housing.

As compared with the known glass heat exchangers, the thermal conductivity of silicon-infiltrated silicon carbide is greater by a factor of 10 to 100. Moreover, the manufacture from tube sections and perforated sheets of ceramics, as described in detail in DE-A-3,643,749, has advantages. The heat exchanger is equally suitable for heat exchange between gas/gas, gas/liquid and liquid/liquid. The hot and/or corrosive medium is here to be passed through the tubes. It is particularly suitable as a reheating surface for heat recovery from hot flue gases from boilers, refuse incinerators and firing installations for ceramic materials.

Figure 1:
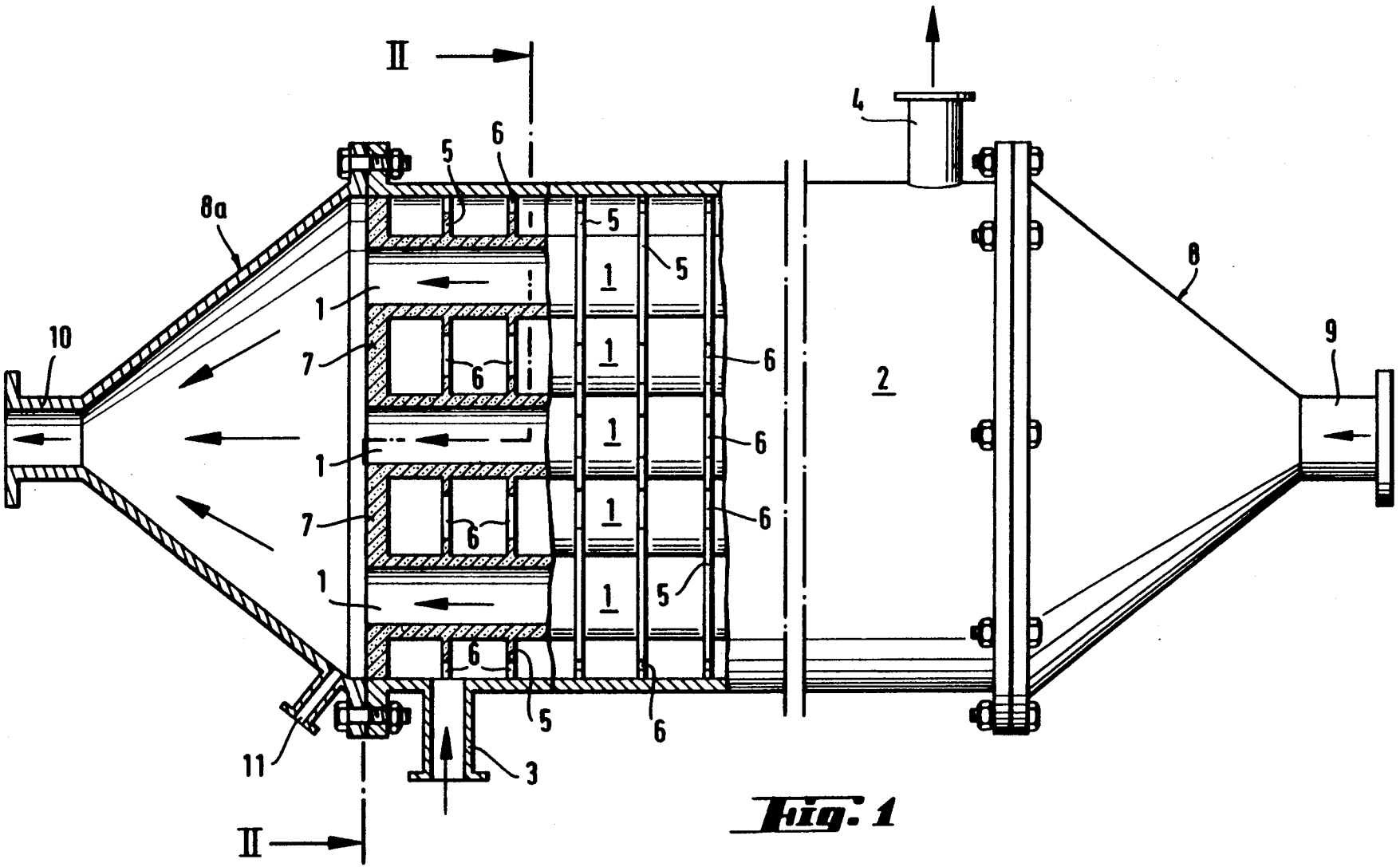
Figure 2:
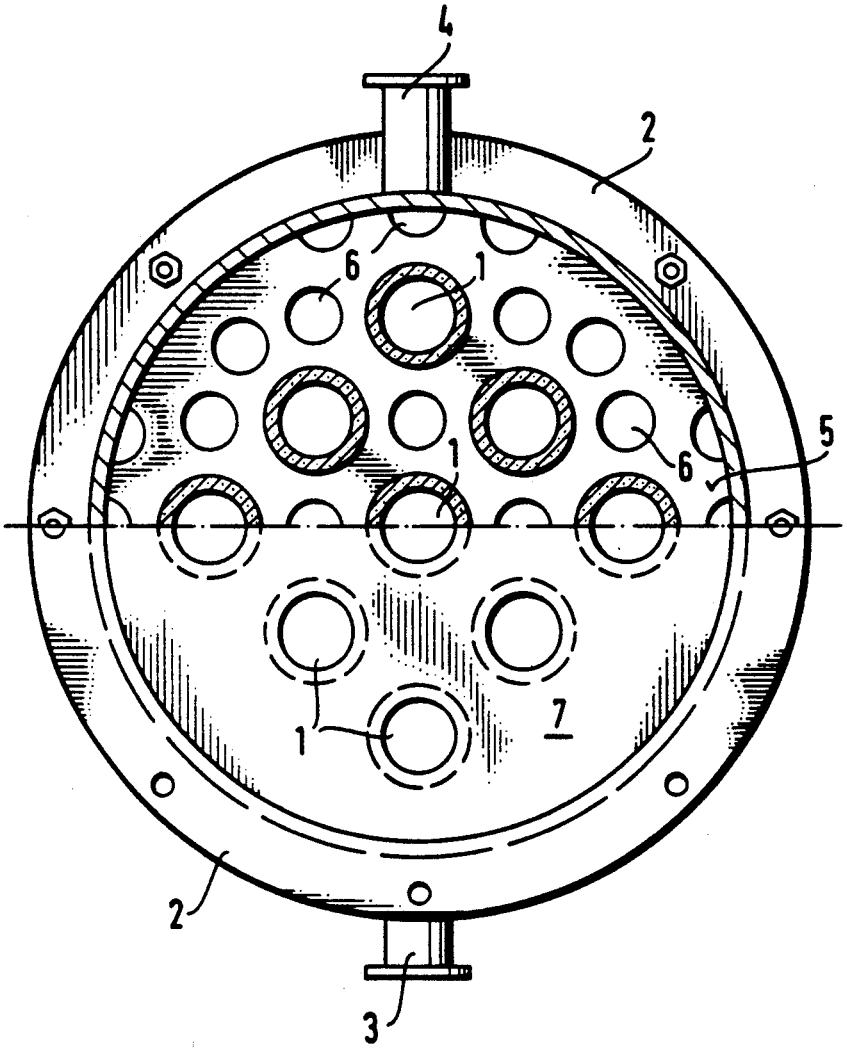
Figure 3:
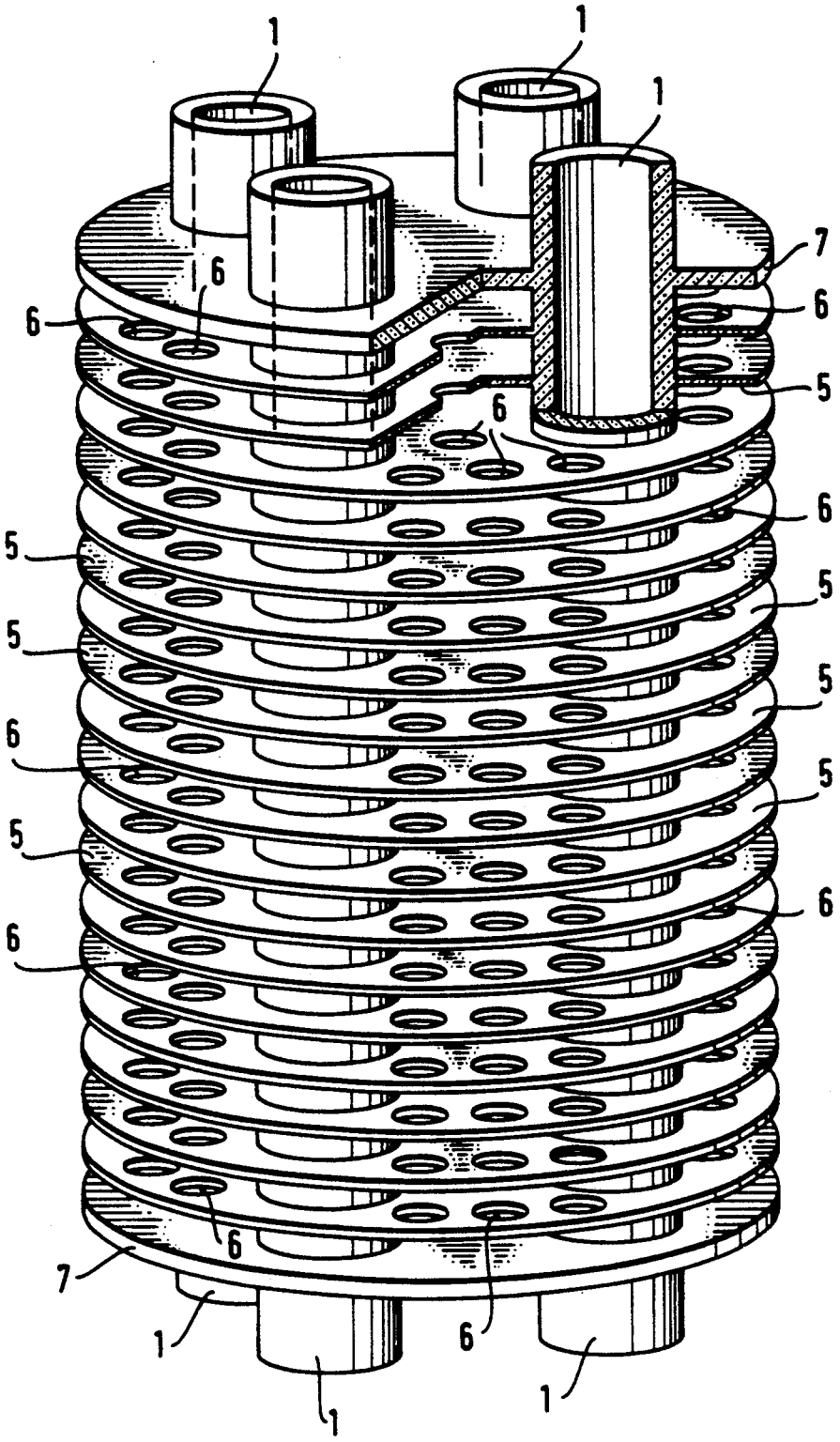

The invention is explained in more detail below by reference to drawings which represent only one type of embodiment and in which:

FIG. 1 shows a side view of the finned-tube heat exchanger, partially in section, FIG. 2 shows the section 2—2 of FIG. 1 and FIG. 3 perspectively shows the tube bundle of 4 tubes, provided with fins.

The tubes 1 of the heat exchanger are arranged mutually parallel in a housing 2. The tubes 1 are joined to one another by fins 5. The fins 5 are arranged transversely to the tubes 1 and provided with apertures 6, through which the cooling medium flowing around the tubes 1 passes from fin to fin. The flue gases or hot liquids pass via the inlet 9 into the heat exchanger and are distributed via the header 8 over the tubes 1. Flue gas or liquid leaving the tubes is collected in header 8*a* and passed to the outlet 10. Any condensate being obtained is taken off via the condensate outlet 11 in header 8*a*. The cooling medium passes via the inlet 3 into the heat exchanger and leaves the latter via the outlet 4. The tubes 1 each end in head plates 7 which seal the space, around which the cooling medium flows, from the headers 8 and 8*a*. The tube bundle with fins 5 can be constructed as a module from correspondingly perforated sheets and tube sections of unfired ceramic material and then processed to give a monolith. The monolithic module is then sealed with its head plates 7 into the housing 2. The housing can be made of plastic, graphite, metal or the like, as can the head plates 7.

We claim:

1. A finned-tube heat exchanger comprising a plurality of mutually parallel tubes arranged in a tube bundle so that a cooling medium can flow around the tubes, a housing provided with an inlet and outlet for the cooling medium and surrounding the tube bundle, and a plurality of fins which have apertures and are arranged transversely to the tube bundle for joining the tubes to one another, wherein the tubes and fins are comprised of silicon-infiltrated silicon carbide.

2. The finned-tube heat exchanger as claimed in claim 1, wherein the housing is of cylindrical shape, and the fins have a circular cross-section and are arranged with their edges along the housing.

3. The finned-tube heat exchanger as claimed in claim 1, wherein the tube bundle with fins comprises a monolithic module formed from at least one perforated sheet and at least one tube section of unfired ceramic material.

* * * * *